United States Patent [19]

Cone

[11] Patent Number: 4,821,784

[45] Date of Patent: Apr. 18, 1989

[54] TOOL FOR REMOVING LATERAL DEFLECTION IN A WOOD PLANK

[76] Inventor: Michael P. Cone, 714 Worthshire, Houston, Tex.

[21] Appl. No.: 103,054

[22] Filed: Sep. 30, 1987

[51] Int. Cl.[4] ..... B27H 1/00

[52] U.S. Cl. ..... 144/381; 254/17

[58] Field of Search ..... 254/15, 16, 17; 144/2 R, 381, 25 S

[56] References Cited

U.S. PATENT DOCUMENTS 1,665,430 4/1928 Arzt ..... 254/17

4,621,791 11/1986 Staskiewicz et al. ..... 254/17

FOREIGN PATENT DOCUMENTS 932305 7/1963 United Kingdom ..... 254/17

*Primary Examiner*—W. Donald Bray

*Attorney, Agent, or Firm*—Pravel, Gambrell, Hewitt, Kimball & Krieger

[57] ABSTRACT

A compact tool adapted for removing lateral deflection from a wood plank is disclosed. The tool is provided with a reduced friction connection interengaged with an elongated member and a fastener for removably positioning a U-shaped bracket for receiving a wood joist member or, alternatively, a fastener member for engaging a fixed flat surface, such as plywood. Additionally, a cylindrical member is disposed on an end of the elongated member for reducing a friction factor between the elongated member and the wood plank and for providing a rolling load to remove the lateral deflection in the wood plank.

The tool of the present invention provides a method to quickly and efficiently remove lateral deflection from a wood plank while reducing damage to the wood joist member or plywood base.

12 Claims, 2 Drawing Sheets

10
10'
12
12A
12A'
12B
12C
14A
14A'
14B
14B'
16
16A
16B
18A
18B
20
20A
20B
22
22A
22B
24
26
28A
28B
28C
28D
30A
30B
30C
30D
30E
32
34
36
38
38A
40
40A
42
44
46A
48A
48B
50A
52A
54
56A
56B
56C
56D
56E
J
P

TOOL FOR REMOVING LATERAL DEFLECTION IN A WOOD PLANK

BACKGROUND OF THE INVENTION

1. Technical Field of the Invention

This invention relates to tools and methods for removing lateral deflection in a wood plank, particularly for installation of outdoor decking and indoor floors.

2. Description of the Prior Art

Outdoor wood decks have become popular in the last decade as people desire to enjoy the great outdoors while enjoying the convenience of the close proximity of their home. This has created a consumer demand for both the installation of wood decks with new homes and the retrofitting of wood decks on existing homes.

Additionally, there has been, and probably will always be, the desire to have the durability and beauty of natural wood floors inside homes including the popular tongue-and-groove type wood flooring planks.

The procedure for installation of these wood decks and wood floors includes laying an initial structural support; i.e. a joist structure and a flat plywood base, respectively; for the wood planks to be secured thereon. One of the problems that is experienced by the installers of these wood decks and wood floors is when a wood plank is received warped or with a lateral deflection. Because of the expense of these planks, the installer is usually inclined to work with the plank to align it so as to remove the lateral deflection in the wood plank.

FIG. 1 shows a prior art device used by installers to remove this deflection. The installer uses a 2×4 WP or similar available wood plank. A nail N is used, as shown in FIG. 1, to fasten the 2×4 WP to a wood joist J to move the wood plank P into alignment. When the plank P is aligned or perpendicular with the joist J, the installer will nail down the wood plank P and then pry or remove the 2×4 WP with nail N from the wood joist J.

As can be seen, this primitive prior art method is not only time-consuming but also requires the nailing of the 2×4 into the wood joist which damages the wood joist J and could possibly split the joist J during the removal of the 2×4 from the joist or on loading of plank P by the 2×4 WP.

This prior art method is therefore undesirable in (1) consumption of time, (2) damage to the joist J to which the 2×4 WP is fastened, and (3) the need to periodically change a bent nail N and damaged 2×4 WP. Also as can be seen in FIG. 1, the direct contact of the edge of the 2×4 WP with the wood plank P applies a sharp gouging loading which is detrimental to the wood plank. Also, this primitive method and device is not efficiently designed to reduce a friction loading both at the rotation of the 2×4 relative to the joist J and the loading of the edge of the 2×4 which contacts the wood plank P.

SUMMARY OF THE INVENTION

Briefly, according to the invention a compact tool adapted for removing lateral deflection from a wood plank is provided. The tool comprises an elongated member, having a connector position intermediate its ends, that is securable by a fastener adjacent the wood plank. A pivotal connection is provided to connect the elongated member at the connector position with the fastener to allow the first end of the elongated member to pivot about the connector position relative to the fastener between a non-loading position and a loading position to remove lateral deflection in a wood plank.

Additionally, the tool is provided with a removable connection interengaged with the elongated member and fastener for removably positioning a U-shaped bracket for receiving a wood joist member, or alternatively, a substantially flat fastener member for engaging a fixed flat surface, such as plywood. Additionally, a cylindrical member is disposed on the first end of the elongated member. This cylindrical member provides a rolling load and reduces a friction factor between the tool and the plank during installation of the plank when the loading is applied to remove lateral deflection.

The tool of the present invention provides a method to quickly and efficiently remove lateral deflection from a plank while reducing damage to the wood joist member or plywood base during installation of the decking or floor, respectively.

BRIEF DESCRIPTION OF THE DRAWINGS

The objects, advantages and features of the invention will become more apparent by reference to the drawings which are appended hereto wherein like numerals indicate like parts and wherein an illustrative embodiment of the invention is shown, of which.

DESCRIPTION OF THE PREFERRED EMBODIMENT

The tool of the present invention, indicated generally at 10, is adapted for removing lateral deflection from a plank P. The tool 10 is advantageously fabricated to allow its use for both installation of outdoor wood decking, as shown in FIGS. 2–6, where the tool is connected to a wood joist J or, alternatively, the tool 10', as shown in FIGS. 7 and 8, may be used with a substantially flat surface, such as a plywood base, for the installation of indoor wood flooring, such as the popular tongue-and-groove flooring.

The preferred tool 10 includes an elongated tubular member 12 having a first end 12A and a second end 12B and having a connector position 12C intermediate its ends. Additionally, the tool 10 includes a U-shaped bracket 14A for fastening the elongated member 12 to a wood joist J or, alternatively, a substantially flat block fastener member 14B, as shown in FIGS. 7 and 8, for engaging a flat surface.

Additionally, the tool 10 includes a rotatable cylindrical member 16 on the first end 12A of the elongated tubular member 12. Cylindrical member 16 reduces a friction factor and provides a rolling load between the elongated member 12 and the wood plank P to aid in the removal of the lateral deflection in the wood plank.

Figures 5, 6, 7, 8:
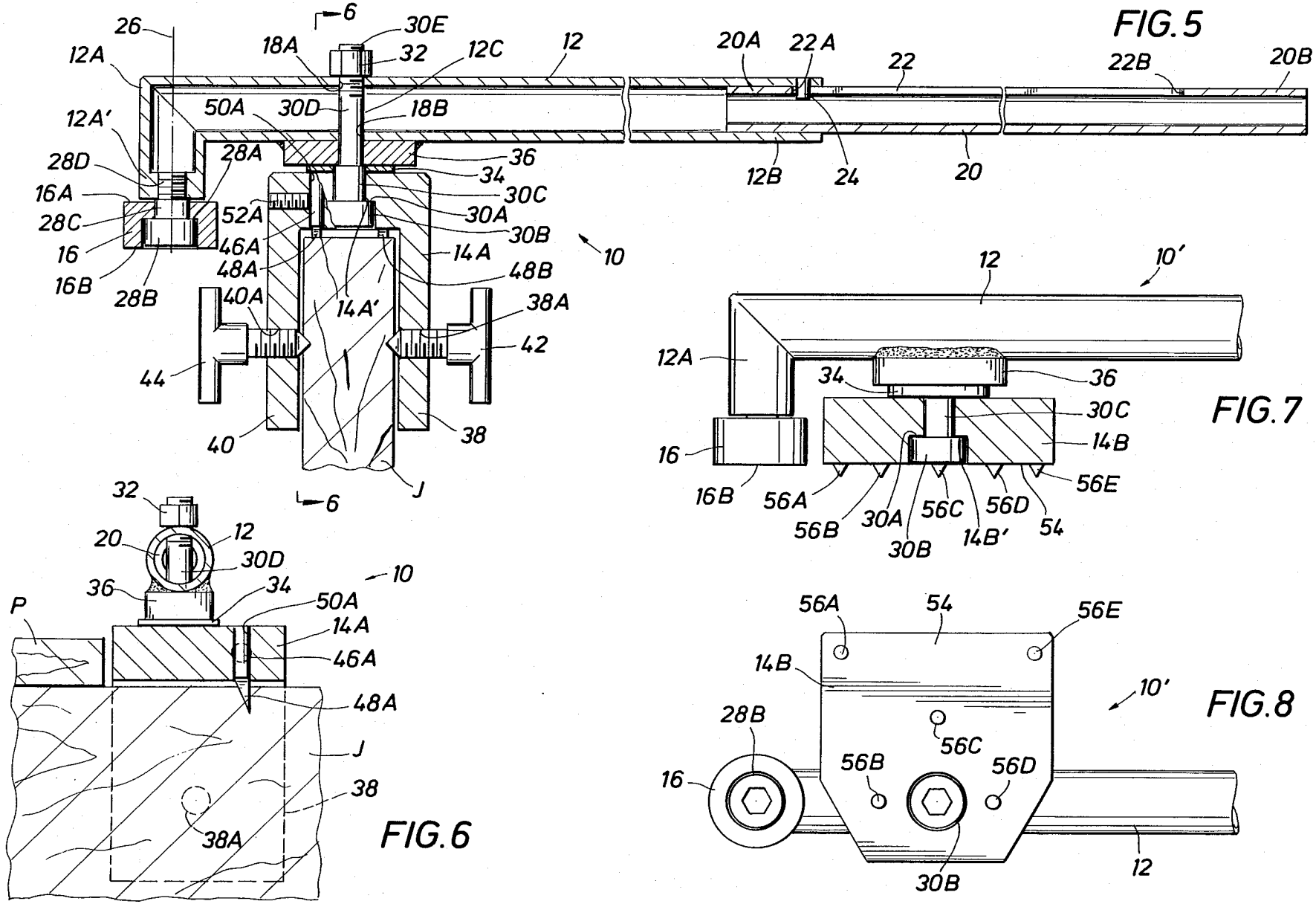
FIG. 5 is an enlarged elevational sectional view of the tool.
FIG. 6 is a section view taken along line 6—6 of FIG. 5.
FIG. 7 is an alternative fastener member of the present invention for installing wood flooring on a flat surface.
FIG. 8 is a bottom view of the alternative embodiment of the present invention as shown in FIG. 7.

Turning now to FIG. 5, a sectional view of the tool 10 of the present invention is shown. The elongated tubular member 12 from its first end 12A to its second end 12B is approximately 20" in length. A preferred location of the connector position 12C is 3" from the first end 12A or 17" from the second end 12B and comprises aligned holes 18A and 18B.

A second elongated member 20, shown in broken view in FIG. 5, has a first end 20A and a second end 20B telescopically disposed in the interior of the first elongated member 12. The second elongated member 20 has a slot 22 therein. The slot 22 has a first stop shoulder 22A and a second stop shoulder 22B which engages guide pin 24 when the second elongated member 22 is in the extended operating position, as shown in FIGS. 2–5, and the retracted compact position (not shown), respectively. This tool provides a compact tool which advantageously allows it portable use from location to location by the installer and allows use of the tool in restricted space areas. When in the extended position the tool allows additional leverage or moment arm to be applied by the first end 12A to the wood plank P being installed. Preferably, the second elongated member 20 extends an additional 14" from the second end 12B of the elongated tubular member 12 to provide an overall length of approximately 34" for the tool in the extend operating position.

The first end 12A of the tool 10 includes a lower portion 12A'. Cylindrical member 16 having an axis 26 has an upper surface 16A and a lower surface 16B and includes a bolt 28 interengaged with the lower portion 12A' of the first end of the elongated member 12. The bolt 28 is inset in cylindrical member 16 to prevent snagging or interference during operation of the tool 10. The bolt 28 is coaxially aligned with the portion 12A' and the cylindrical member 16. As shown in FIG. 5, the bolt 28 comprises a shoulder 28A defined by the larger diameter portion 28B and the smaller diameter portion 28C. Shoulder 28A engages a cylindrical member shoulder 16C to provide rotatable reduced friction mounting of the cylindrical member 16 to the elongated member 12. The bolt 28 includes a threaded portion 28D which is received into a threaded bore hole of the lower portion 12A'.

A second elongated bolt 30, shown in detail in FIG. 5, has a shoulder 30A defined by a larger diameter portion 30B and a smaller diameter portion 30C. Shoulder 30A is fabricated to engage either the shoulder 14A' of the preferred embodiment fastener member 14A or the shoulder 14B' of the alternative embodiment fastener member 14B, as shown in FIGS. 7 and 8. Preferably the bolt 30 has a finished reduced diameter portion 30D which engages the openings 18A and 18B, as best shown in FIG. 5, and at its end a threaded portion 30E onto which a bolt 32 is threaded to pivotally releasably connect the elongated member 12 at its connector position with a fastener 14. Therefore, this fastening mechanism provides reduced friction pivotal connection of the elongated member 12 with fasteners 14, and also provides a kit for either positioning of the U-shaped bracket 14A, as seen in FIG. 5, for securement to a joist J or, alternatively, allows the connection of the fastener member 14B for engaging a flat surface such as plywood. One basic compact tool can be used for two different installation procedures. The installer therefore has two tools in one.

Both embodiments include a washer 34 positioned between the fastener 14 and a plate 36 welded to the elongated member 12 to provide reduced friction in the pivoting of the tool.

The U-shaped bracket 14A, as best shown in FIGS. 5 and 6, has a first leg 38 and a second leg 40. The legs 38 and 40 are parallel and spaced part a sufficient distance to enable receiving a fixed securing member, such as joist J. Preferably the spaced-apart distance is $1\frac{3}{4}$" since the wood joist usually has a distance of $1\frac{5}{8}$" but other sizes of brackets may be used. Fastener 14A is fabricated of aluminum and includes threaded bores 38A and 40A in legs 38 and 40 to receive T-shaped threaded screw clamps 42 and 44, respectively, therein to aid in preventing movement of the bracket 14A relative to the joist J. These clamps 42 and 44 are particularly useful when the tool 10 is used during installation of a vertical structure, such as a wall. The clamps 42 and 44 fastened to a vertical column aids in maintaining the position of the tool 10 relative to a wood plank P.

It may be found at times that the clamps 42 and 44 would not be needed such as during the installation of horizontal surface, such as wood decking, because of a pair of studs 46A and 46B having bits 48A and 48B, respectively, secured thereon to engage the joist J, as best shown in FIG. 6. The studs 46 are designed to be received in sized openings 50A and 50B (not shown) and set screws 52A and 52B, respectively, are provided in an additional opening in the fastener 14A to allow removable positioning of the studs 46.

Turning now to FIGS. 7 and 8, the alternative fastener member 14B is shown which is removably secured by the bolt 30, as previously discussed above. As best shown in FIG. 7, lower surface 16B of the cylindrical member 16 is approximately the same elevation as the bottom surface 54 of the fastener member 14B to allow proper alignment of the cylindrical member 16 with the wood flooring to be installed. A plurality of short spikes 56A, 56B, 56C, 56D and 56E are used to engage the plywood to prevent movement of the fastener member 14, and therefore the tool 10', during the installation of flooring. The spikes 56 are preferably removable from the member 14B to allow their replacement. The other parts of the tool 10' are identical to tool 10, as discussed above, except that the fastener 14B is advantageously removable and replaceable with the U-shaped bracket 14A.

USE AND OPERATION

Figure 1:
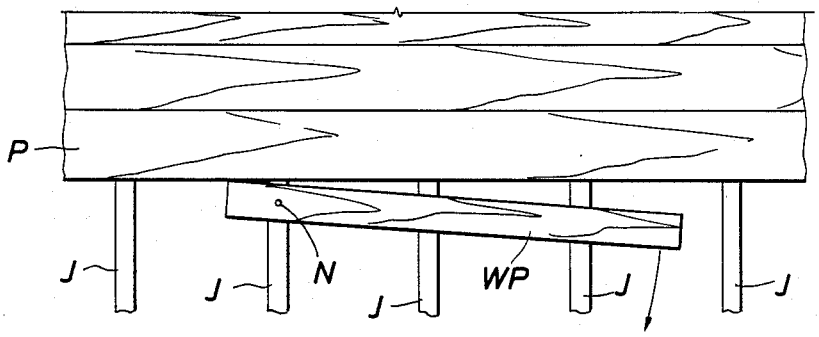
FIG. 1 (PRIOR ART)
FIG. 1 is a plan view of a prior art apparatus and method for removing lateral deflection in wood decking.
Figure 2:
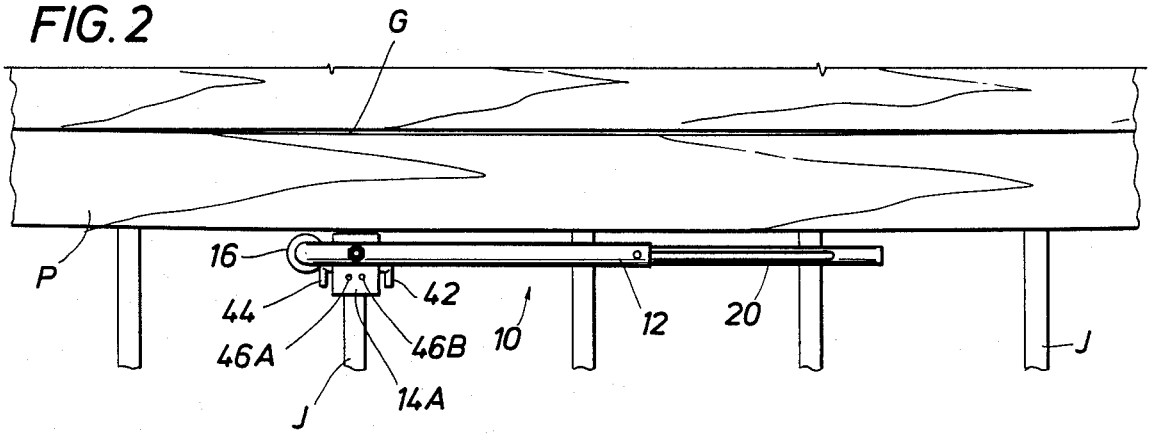
FIG. 2 is a plan view of a tool of the present invention in a non-loaded position secured to a wood joist.
Figure 3:
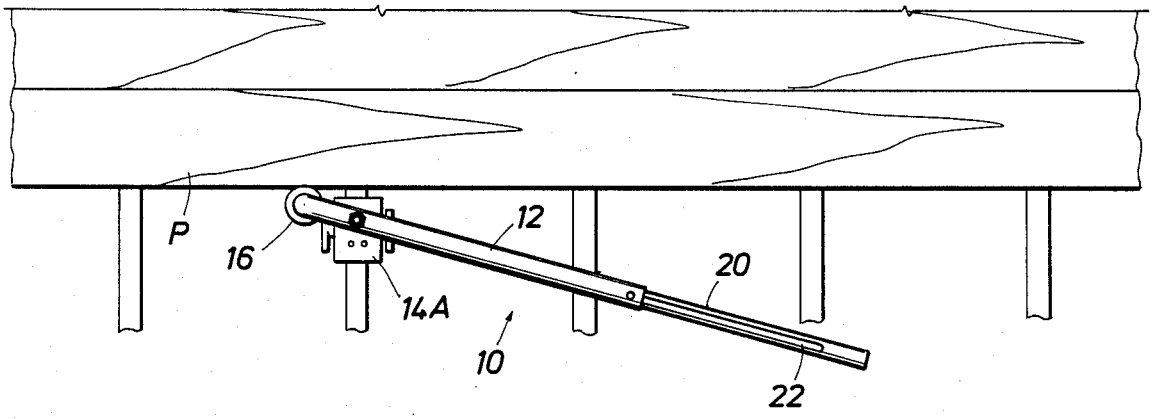
FIG. 3 is similar to FIG. 2 but illustrates the tool in the loaded position for removing lateral deflection in the plank.
Figure 4:
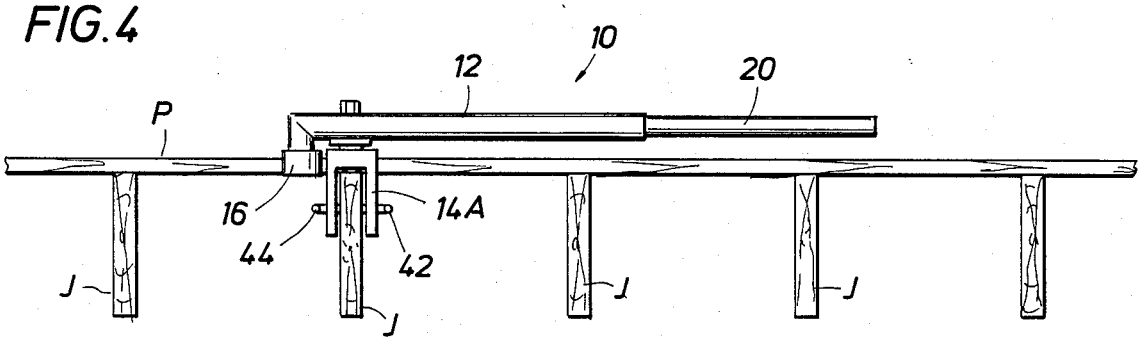
FIG. 4 is an elevational view of the tool illustrating the securement of the fastener bracket to the wood joist.

The method for removing the lateral deflection in the wood plank during its installation comprises the use of the tool 10 disclosed above where the elongated member is positioned as shown in FIGS. 2–4 relative to the wood plank P. The elongated member 12 would initially be positioned substantially parallel to the wood plank P, as shown in FIG. 2. In the preferred embodiment the U-shaped bracket 14A would be secured as the joist J. As discussed above, the clamps 42 and 44 may or may not be secured to the joist J, as desired by the installer. The tool 10 as positioned in FIG. 2 with the elongated member 20 in the extended position is then rotated clockwise to allow the cylindrical member 16 attached to the elongated member 12 to apply a rolling load to the wood plank P to remove lateral deflection and, therefore, close the gap G as shown in FIG. 2. The plank P is then nailed to the joist in this aligned position.

As can be seen, the cylindrical member 16 advantageously provides a rolling load and reduces the friction factor between the elongated member and the wood plank. In the same fashion the alternative embodiment fastener 14B is placed on the plywood and the tool is rotated to apply a rolling load to the flooring plank. After the job is completed, the elongated member 20 is retracted back into the first elongated member 12 to provide a compact portable tool.

Various modifications and alterations in the disclosed apparatus and methods will be apparent to those skilled in the art of the foregoing description which does not depart from the spirit of the invention. For this reason, these changes are to be considered included in the appended claims. The appended claims recite the only limitation of the present invention, and the descriptive manner which is employed for setting forth the embodiments is to be interpreted as illustrative and not a limitation.

I claim:

1. Apparatus adapted for removing lateral deflection from a wood plank, comprising a first elongated member having a first end and a second end and having a connector position intermediate its ends.

a fastener means having an upper surface for positioning said elongated member adjacent the wood plank, means for pivotally connecting said elongated member at said connector position with said upper surface of said fastener means, said first end of said elongated member pivoting about said connector position relative to said fastener means between a nonloading position and a loading position to remove lateral deflection in the wood plank, and cylindrical means rotatable relative to and disposed on said first end for reducing friction between said elongated member and the wood plank.

2. Apparatus of claim 1 wherein said fastener means comprises a U-shaped bracket having a first leg and a second leg, said legs joined at said upper surface being parallel and spaced apart a sufficient distance to enable receiving a fixed securing member.

3. Apparatus of claim 1 wherein said fastener means comprises a fastener member having an upper surface and a lower surface, and means disposed on said lower surface for resisting movement of said fastener member when engaged with a fixed surface.

4. Apparatus of claim 1 further comprising means interengaged with said elongated member and said fastener means for removably positioning a U-shaped bracket for receiving a fixed member or, alternatively, a fastener member for engaging a fixed surface.

5. Apparatus of claim 1, further comprising a second elongated member having a first end and a second end, and means for movably mounting said first elongated member with said second elongated member, said second elongated member movable relative to said first elongated member between a retracted position and an extended position for providing additional loading to the wood plank.

6. Apparatus of claim 1 wherein said cylindrical means for reducing comprises a cylindrical member having an axis and having an upper surface and a lower surface, and means interengaged with said first end of said elongated member and said cylindrical member for rotatably mounting said first end with said cylindrical member along said cylindrical member axis.

7. Apparatus of claim 2 wherein said U-shaped bracket further comprises means for preventing movement of said bracket relative to the fixed securing member.

8. Apparatus of claim 4 further comprising, means disposed on said first end for reducing a friction factor between said elongated member and the wood plank when a loading is applied to remove the lateral deflection.

9. Apparatus adapted for removing lateral deflection from a wood plank, comprising an elongated member having a first end and a second end and having a connector position intermediate its ends, a fastener means having an upper surface for positioning said elongated member adjacent the wood plank, means for pivotally connecting said elongated member at said connector position with said upper surface of said fastener means, said first end of said elongated member pivoting about said connector position relative to said fastener means between a nonloading position and a loading position to remove lateral deflection in the wood plank, means interengaged with said elongated member and said fastener means for removably positioning a U-shaped bracket for receiving a fixed member or, alternatively, a fastener member for engaging a fixed substantially flat surface, and cylindrical means rotatable relative to and disposed on said first end of said elongated member for reducing friction between said elongated member and the wood plank when a loading is applied to remove the lateral deflection in the wood plank.

10. Apparatus of claim 9 wherein said U-shaped bracket comprises a first leg and a second leg, said legs being parallel and spaced apart a sufficient distance to enable receiving a fixed securing member.

11. Apparatus of claim 9 wherein said fastener member comprises an upper surface and a lower surface, and means disposed on said lower surface for resisting movement of said fastener member when engaged with a fixed surface.

12. A method for removing lateral deflection in a wood plank during its installation, comprising the steps of:

providing an elongated member having a first end and a second end being pivotally connected to an upper surface of a fastener means, positioning the fastener means adjacent the wood plank to operably enable rotation of the elongated member relative to said fastener means to allow the first end of said elongated member to apply a load to the wood plank to remove lateral deflection in the wood plank, and reducing friction between said elongated member and the wood plank when applying the load to the wood plank with a cylindrical member rotatable relative to said elongated member.

* * * * *